US005337897A

United States Patent [19]

Yablans

[11] Patent Number: 5,337,897

[45] Date of Patent: Aug. 16, 1994

[54] SAMPLER CARTRIDGE DISPLAY CASE AND UNIT SAMPLER

[76] Inventor: Gerald Yablans, #4 Sycamore Dr., Port Washington, N.Y. 11050

[21] Appl. No.: 24,842

[22] Filed: Feb. 25, 1993

Related U.S. Application Data

[63] Continuation of Ser. No. 555,521, May 21, 1990, abandoned.

[51] Int. Cl.[5] ..... A45D 40/00

[52] U.S. Cl. ..... 206/581; 206/385; 206/489; 206/823; 221/229; 221/279

[58] Field of Search ..... 221/226, 227, 228, 229, 221/279, 252; 206/581, 385, 495, 823, 486, 488, 489, 45.14

[56] References Cited

U.S. PATENT DOCUMENTS

| | | | |
|---|---|---|---|
| 274,400 | 3/1883 | Soper | 221/228 |
| 470,079 | 3/1892 | Senner | 221/229 |
| 545,803 | 9/1895 | Klug | 221/227 |
| 2,042,584 | 6/1936 | Bustamante | 206/385 |
| 2,547,252 | 4/1951 | Bouchard et al. . | |
| 2,779,522 | 1/1957 | Puckett | 221/279 X |
| 2,781,151 | 2/1957 | Campbell, Jr. | 221/45 X |
| 2,960,259 | 11/1960 | Aveni | 221/229 |
| 3,397,818 | 8/1968 | Rey | 221/229 |
| 3,953,090 | 4/1976 | Fuchs | 221/279 X |
| 4,311,251 | 1/1982 | Sternberg | 221/229 X |
| 4,328,184 | 5/1982 | Kondo . | |
| 4,339,035 | 7/1982 | Marcus et al. . | |
| 4,465,208 | 8/1984 | Buban et al. | 221/279 |
| 4,666,040 | 5/1987 | Murata | 206/489 X |
| 4,752,002 | 6/1988 | Takahashi et al. . | |
| 4,773,532 | 9/1988 | Stephenson . | |
| 4,786,534 | 11/1988 | Aiken | 206/581 X |
| 4,807,760 | 2/1989 | Sussman | 206/581 |
| 4,844,256 | 7/1989 | Honegger . | |
| 4,849,090 | 7/1989 | Case et al. . | |
| 4,860,899 | 8/1989 | McKee . | |
| 4,876,136 | 10/1989 | Chang et al. | 206/385 X |
| 5,031,647 | 7/1991 | Seidler | 206/581 X |

*Primary Examiner*—Jacob K. Ackun, Jr.
*Attorney, Agent, or Firm*—Nolte, Nolte and Hunter

[57] ABSTRACT

A cartridge containing a stack of samplers, dispensed one by one through an end slot in the cartridge and a display case to contain a plurality of such cartridges together with identifying indicia and actual product and a unitized structure constituting a display case formed with a plurality of integral chambers each structured to function in the manner of said cartridge.

6 Claims, 6 Drawing Sheets

FIG. 1
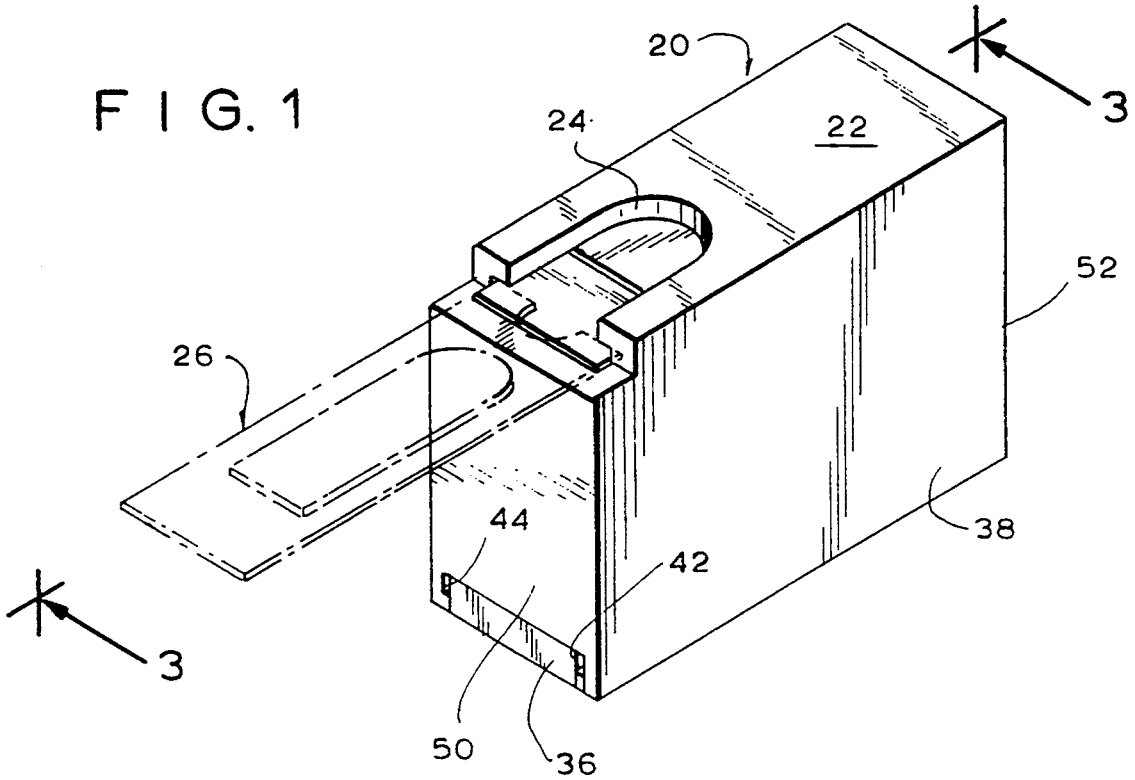
FIG. 9
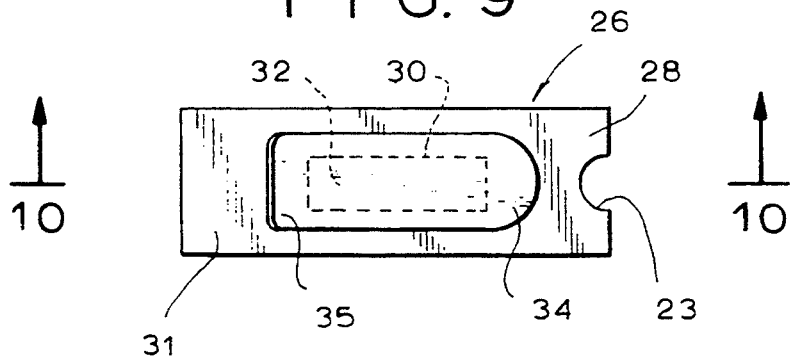
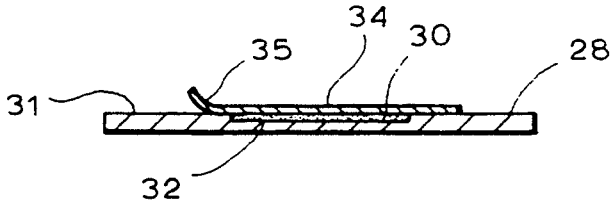
FIG. 10

FIG. 5
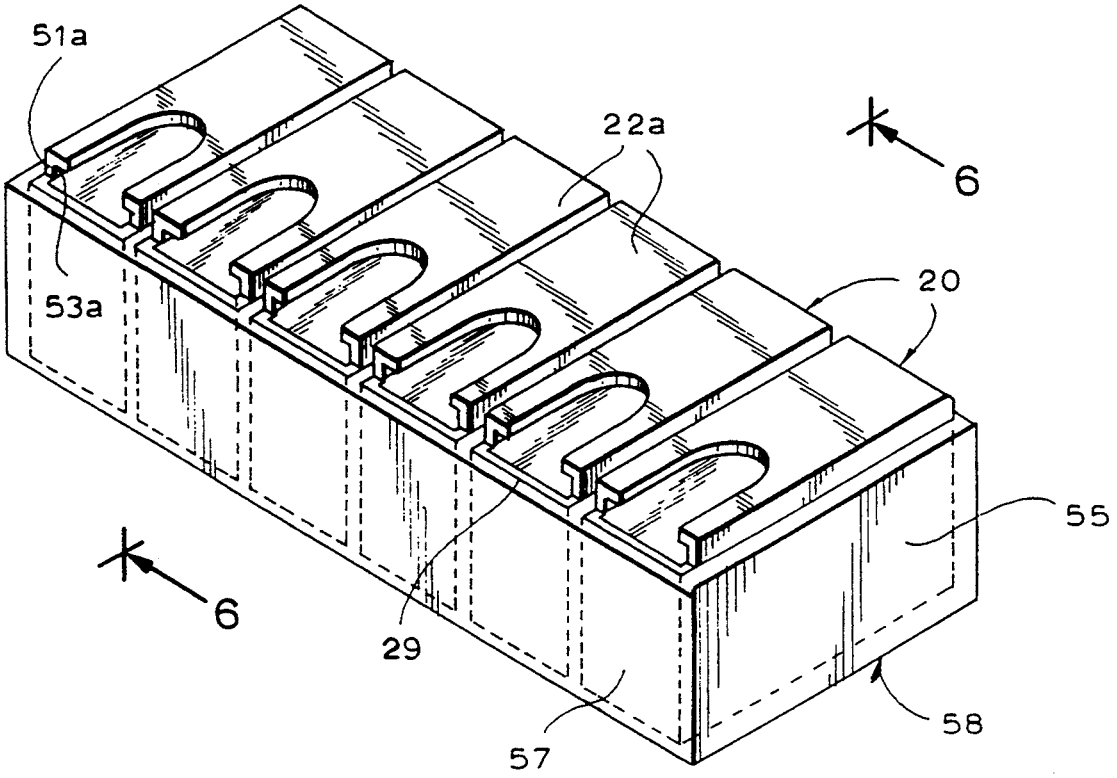
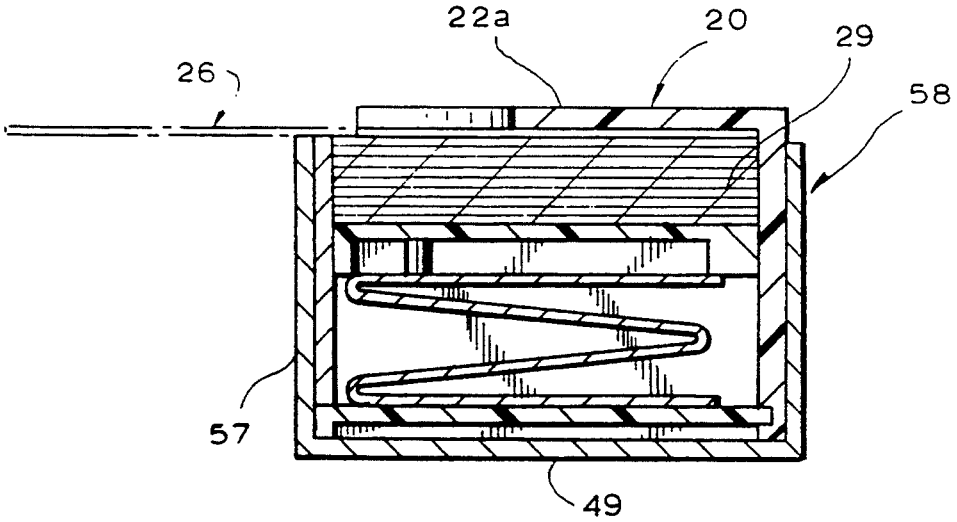
FIG. 6

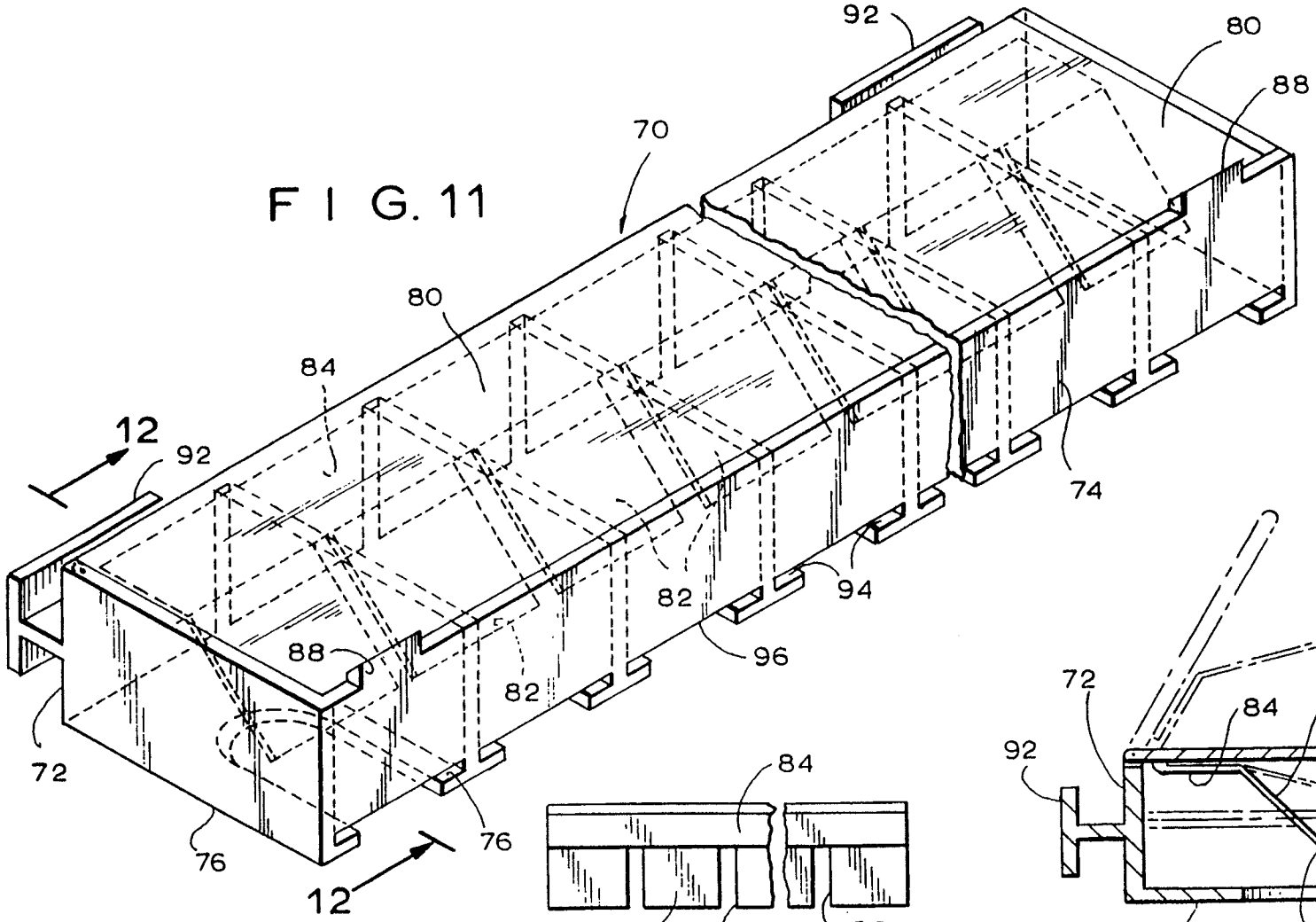
FIG. 11
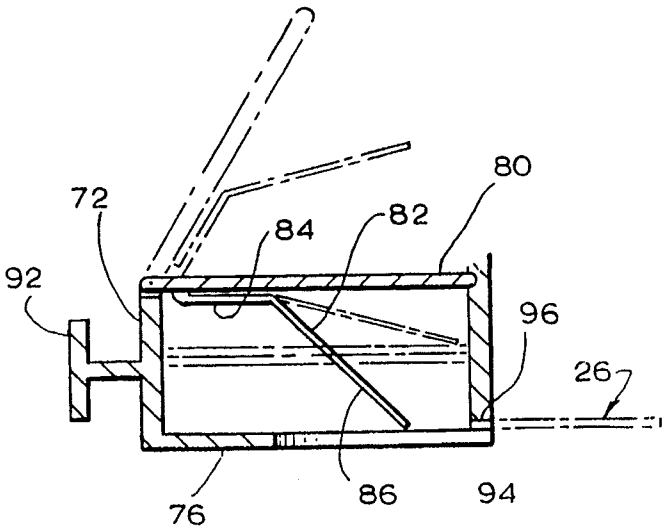
FIG. 12
FIG. 13

SAMPLER CARTRIDGE DISPLAY CASE AND UNIT SAMPLER

This is a continuation of application Ser. No. 07/555,521 filed May 21, 1990.

BACKGROUND OF THE INVENTION

It is a desirable merchandising practice with cosmetics, particularly lipstick, blush and/or fragrance, to provide a one use sample so that the customer may observe how the cosmetic and its color or fragrance harmonizes with her. It is unsanitary and counterproductive to provide product in the normal form as, for example, a lipstick, compact or other container. Accordingly, the practice has developed for making small "samplers" which generally consist of a continuous base strip of paper or like material covered by discontinuous cover slips which may be transparent. Cosmetic is sandwiched between the opaque base strip and the cover slips. Trademarks and other identifying legends may be printed on a portion of the base or cover slip or both. The prospective customer after making a preliminary selection among the samplers will raise the cover slip to uncover the cosmetic or perfume which may then be applied to herself for viewing or sampling the fragrance.

This invention relates to a cartridge for dispensing samplers of cosmetics such as rouge, blush, lipstick, eye liner, eye shadow, mascara, face powder and fragrance. It also relates to a display case holding a plurality of such cartridges together with corresponding products and identifying indicia. It is known in the art to dispense samplers as a continuous roll segmented for tear-off into discreet small packages. Such samplers, while a great improvement for sanitary purposes, have proven cumbersome and frequently over feed a plurality of packages or become unravelled and disorderly. Consequently, it is an object of the invention to provide a novel sampler and a cartridge for dispensing individual stacked samplers one by one.

An object of the invention is to provide a cassette adaptable for use with samplers currently on the market. It is another object of the invention to provide a novel sampler, particularly usable in my novel dispenser.

The present invention comprises a cartridge to contain a stack of samplers for delivery one at a time through a dispensing slot located near the top or bottom of the stack. It is a further object of the invention to provide a display case in which a plurality of such cartridges or stacked samplers may be placed in close proximity to identifying indicia and actual merchandise offered for purchase.

Accordingly, it is an object of the invention to provide a cassette such as described above, which may be readily ganged in a display case to permit the user to observe a number of samplers before making her initial selection(s).

It is also an object to provide a display case compartmentalized to provide a plurality of sampler dispensers incorporating the principles of my cartridge.

It is a further object of the invention to provide in combination ganged sampler cassettes or compartments in a display case such as described above with bins for storing and/or dispensing the product corresponding to the samplers in respective cassettes or compartments.

Still another object is to provide a transparent top on the cassettes or compartments through which the sampler may be observed prior to withdrawal by the prospective customer.

BRIEF DESCRIPTION OF THE DRAWINGS

FIG. 1 is a perspective view of a cartridge showing in dotted lines, a partially withdrawn sampler.

FIG. 5 is an isometric view of a display case containing a number of cartridges.

FIG. 6 is taken on the line 6—6 of FIG. 5.

FIG. 9 is a plan view of a sampler.

FIG. 10 is a sectional elevation taken on the line 10—10 of FIG. 7.

FIG. 11 is an isometric of still another embodiment of the invention.

FIG. 12 is a sectional elevation taken on the line 12—12 of FIG. 11 .

FIG. 13 is a fragmentary plan view of a portion of the biasing element shown in the embodiment of FIGS. 11 and 12.

DESCRIPTION OF THE PREFERRED EMBODIMENT

Figure 2:
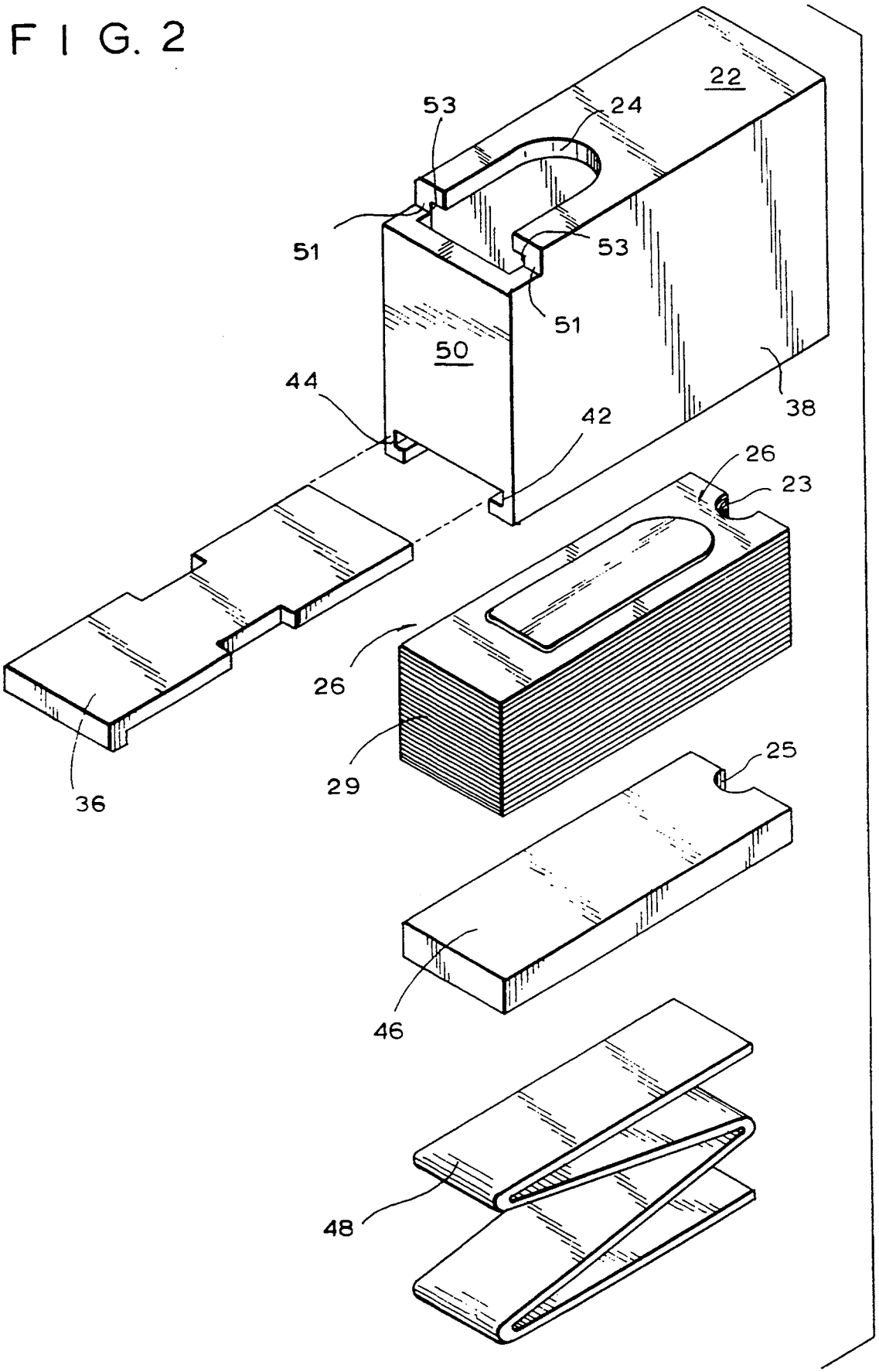
FIG. 2 is an exploded isometric view of a cartridge and samplers.
Figure 3:
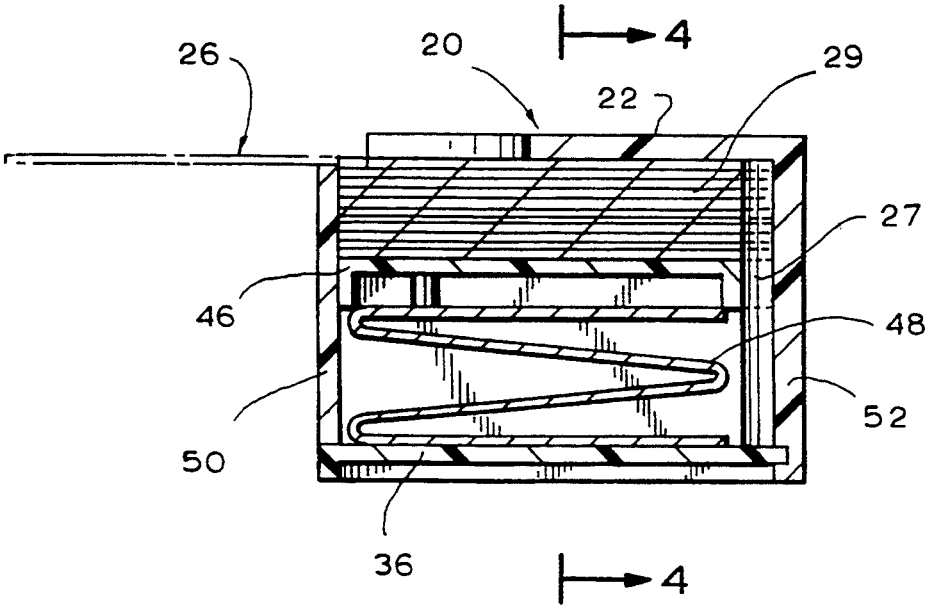
FIG. 3 is a sectional side elevation of a cartridge and samplers.
Figure 4:
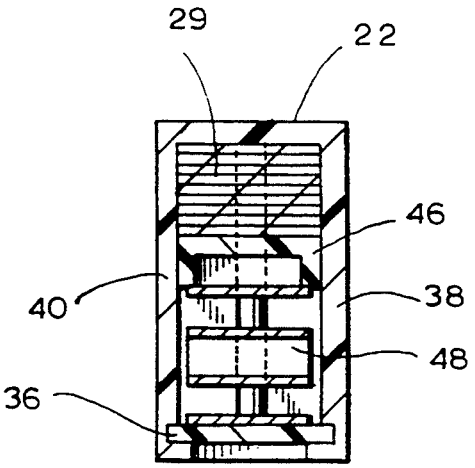
FIG. 4 is taken on the line 4—4 of FIG. 3.

Referring to FIGS. 1, 2, 3 and 4, there is shown the cassette 20 with top 22 in which is formed a finger slot 24 for ejecting a single sampler 26 . Top 22, in a preferred embodiment, is transparent and may be welded or secured by adhesive to the top of the four walls 38, 39, 50, and 52. This permits viewing the top sampler.

Each sampler 26, FIGS. 9 and 10, has a base portion 28 having formed therein a depression 30 in which a sample of the cosmetic 32 may be placed. For example, the cosmetic indicated at 32 may be a small portion of rouge, blush, lipstick or powder, or it may be a pad of absorbent material containing a fragrance. The base portion is elongated and is preferably roughened in the area 31. Cover slip 34 overlies the cavity 30 and is releasably secured as by adhesive or other means to the base plate 28. A tab 35 may be provided to aid in lifting cover slip 34. For visible cosmetics, the cover slip 34 should be of transparent material so that one may view the color. In the case of a fragrance, this of course is not necessary and the cover slip may be decoratively painted, as with flowers.

Referring to FIG. 2, the bottom 36 is slidably secured in the side-walls 38, 39 by insertion in grooves 42, 44. When the bottom 36 is removed, a stack 29 of samplers 26 may be placed in the cartridge followed by the pusher 46. A spring 48 serves as a biasing member against the pusher 46. Spring 48 is compressed and bottom 36 reinserted in grooves 42, 44. The spring and pusher then urge the stack 29 of samplers 26 toward the top 22 of cartridge 20. The top of the front wall 50 has a cutaway 51 forming a s lot 53 to permit the top sampler 26 to slide out of the cartridge 20 by frictional engagement of portion 31 with the finger of a prospective purchaser inserted in the cover slot 24. The pusher 46 has a s lot 25 formed at one end to engage a post or guide 27 located at the wall 52 of the cassette. The sampler has a similar slot 23 to receive the guide 27. This structure tends to stabilize both the pusher and the samplers as they slide upwardly without engaging or with minimal engagement of the side-walls 38, 39 of the cassette.

Referring to FIGS. 1 and 2, the sampler 26 is removed through a slot 53 formed by the cutout 51 adjacent the slot 24. Preferably, the index finger of the user frictionally draws the sampler out. It is also possible to undercut (not shown) the top end-wall 22 in the areas adjacent slot 24 to create a slot (not shown) serving the functional equivalent of slot 53. In such a case, slot 53 may be reduced in size or omitted from wall 50 with the functional equivalent (not shown) in top wall 22.

Referring now to FIGS. 5 and 6, there is shown another embodiment of the invention in a display case 58 having spaced end-walls 55, a bottom 49, a front wall 57 and a spaced back wall 59. The display case 58 is open at the top. Cassettes 20 with their cutouts 51 and slots 53 may be placed in side by side relationship in case 58. In some instances, separators (not shown) may be used to separate the cassettes if desired. Mounted behind either case 58 or case 54 are bins generally indicated at 63 in FIG. 7 only in which products as, for example, compacts, containers of fragrance or lipsticks, may be placed. The angled panel 65 may be positioned to carry identifying indicia for each of the samples in the cassettes 20 and the corresponding adjacent product bin 63. It is understood that the bias 63. It is understood that the bias 63 and indicia panel 65 may be employed with the case 58 shown in FIG. 5 or case 70, shown in FIGS. 11 and 12.

No particular product dispensing bin forms a part of this novel combination of sampler cassettes, product bins and display case. The case 58 with the cassettes 20 therein are adaptable to being secured to and used in combination with bins or product dispensing devices on the market as, for example, devices such as shown in U.S. Pat. Nos. 3,957,174, 2,893,596 and 4,515,290 or my co-pending application filed May 1, 1990, Ser. No. 07/555,520.

Figure 7:
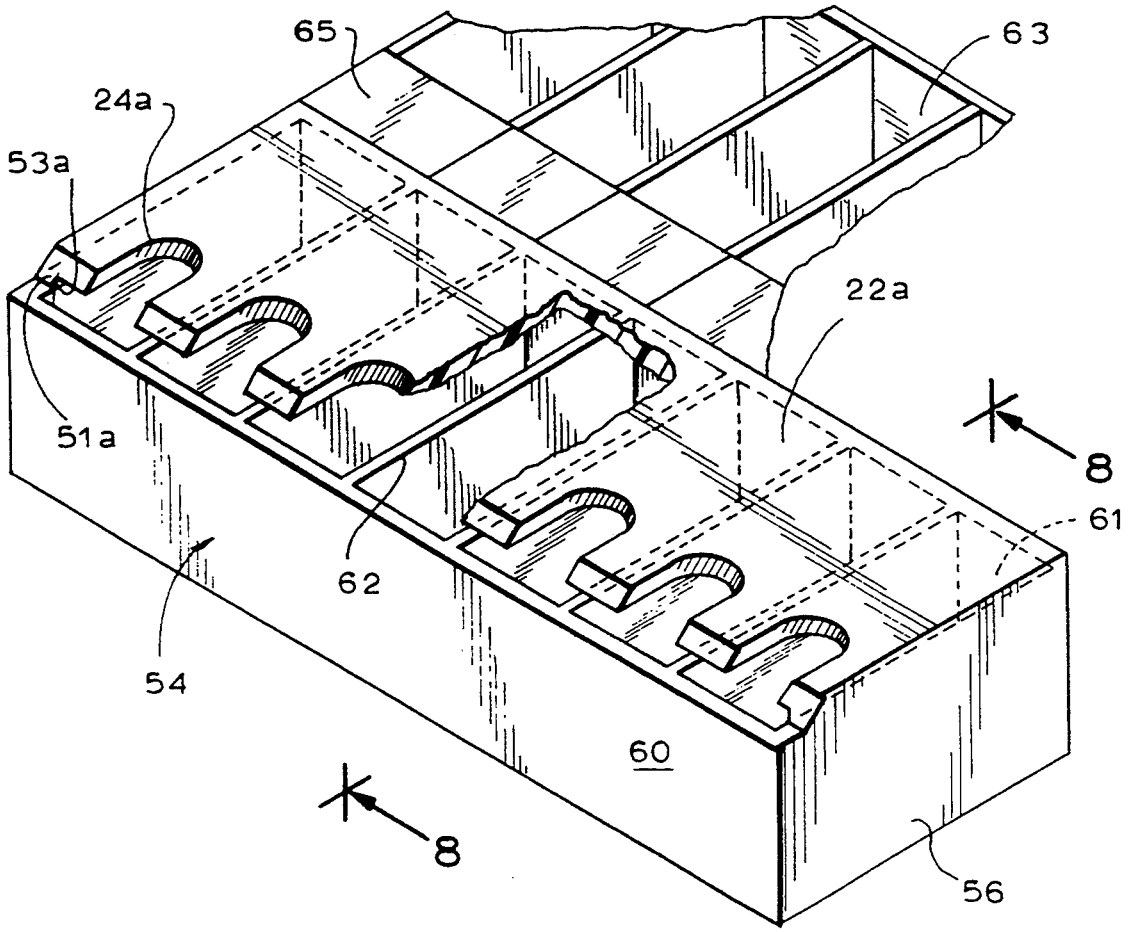
FIG. 7 is an isometric view of another embodiment of the invention.
Figure 8:
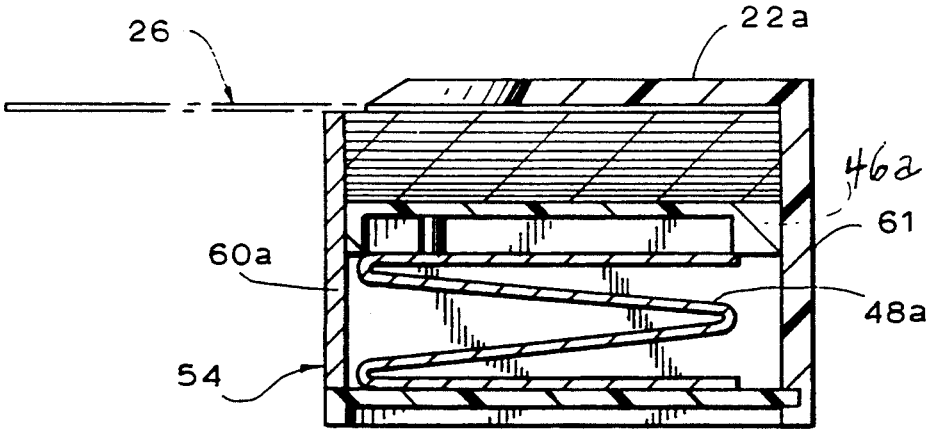
FIG. 8 is a sectional elevation in line 8—8 of FIG. 7.

Referring to FIGS. 7 and 8, a display case 54 is formed of sidewalls 56, front and rearwalls 60, 61 respectively and a top 52. Case 54 is divided by spaced partitions 62 having a plurality of chambers. Top 52 has formed into it slots **24*a* which function as the slot 24 described above and the front wall 60 has a cutaway 51*a* corresponding in function to cutaway 51 to form a slot 53*a* corresponding to slot 53, described above with respect to the cartridge 20. Each of the chambers formed by partitions 62, the bottom, front and rearwalls 60*a*, 60 and 61 respectively receive each a spring 48*a* and a lifter or pusher 46*a*, corresponding to the members 48 and 46 in the cartridge 20. The spring 48*a* and pusher 46*a* move the samplers 29 against the top 22*a*. Samplers 29 may be removed through the slots 24*a* and 53*a*, as described above with respect to slots 24 and 53**.

FIGS. 11, 12 and 13 show another improved embodiment of the invention. The unitary display case 70 is formed with a back wall 72, a front wall 74 and a bottom 76. Case 70 has compartments formed by dividers 78. Hingedly secured to the top of rearwall 72 is a lid 80 to which is secured by means, such as welding, screws, adhesive or the like, (not shown) the base 84 of spring or resilient biasing means 82. Supporting base portion 84 has integral downwardly extending spring fingers 86.

Toward the lateral ends of the case 70 are catches or retainers 88 which hold or secure the lid 80 in the closed position illustrated with fingers 86 pressing downwardly. Fingers 86 are spaced to form slots 90 which straddle or accommodate the separating dividers or partitions 78. T-shaped members 92 may be secured to the rearwall 72 and serve as an attaching plate for clips, screws or other fastening devices to hold the case 70 in a desired location. As for example, it could be used to replace the display case 54 shown in FIG. 7 and the members 92 could secure it to the bins 63 or other desirable structures as, for example, the front of a store counter or its backdrop. A finger slot 94 serves the same purpose as the finger slot 24 shown in the embodiment of FIG. 1. A feed slot 96 is the functional equivalent of slot 53 (FIG. 2). The dependent resilient finger or spring 86 functions as the spring 48 of the embodiment shown in FIGS. 2, 3 and 4. Samplers 26 may be stacked face downward when the lid 80 is in the raised position shown in dotted lines in FIG. 12 and then urged downwardly onto bottom 76 by gravity and the pressure of spring or finger 86. Samplers 26 not shown in FIGS. 11, 12 and 13 may be removed through the slots 96 aided by slots 94 in the same manner as with the slots 24, 53 respectively of FIG. 2.

Similarly, the lid 80 and slotted bottom 76 may be reversed so that the spring fingers 86 extend and exert their bias upwardly to dispose the sampler to the consumer's line of sight. The bottom may then be made removable to load the compartments and stabilized when joined to the display by edge and groove connection between the bottom and back and front walls.

Note that in both instances the spring 82 is made of a resilient plastic with a base 84 along the extension of which integral spring fingers extend angularly relative to the base in the direction of intended bias.

Note also that the lid or bottom may form the base of the spring.

I claim:

1. In combination, a substantially enclosed receptacle forming a dispenser, a plurality of discrete stacked samplers within said dispenser, said stacked samplers each having forward and rearward ends and being slidably removable one by one from said dispenser, the ends of each of said samplers being unconnected to the ends of adjacent samplers in the stack said dispenser having an opening overlying said forward ends only of said samplers stacked therein, each said sampler comprising a flat elongated base with a top and bottom surface, a depression formed in the top surface of said base, a cover slip overlying and extending beyond said depression, said cover slip being releasably secured to said top surface of said base around said depression in sealing relationship to enclose said depression, said base being formed with a roughened surface area on said top surface at said forward end thereof, said roughened surface underlying said opening in said dispenser and comprising means for frictional engagement to supply purchase to slide said sampler from said dispenser.

2. The combination of claim 1 and further characterized in that said cover slip is transparent.

3. The combination of claim 1 and further characterized in that a pad of absorbent material is positioned in the depression of each sampler whereby said pad comprises means for absorbing fragrance and said cover slip comprising means for retaining said fragrance in said depression to minimize evaporation thereof.

4. The combination of claim 1 and further characterized in that each sampler has a notch at one of its ends and said dispenser has a guide with which said notch mates and by which said sampler is guided when moved in a direction perpendicular to its top surface.

5. A display case having a plurality of rectangular chambers formed therein in side by side relationship, said chambers having sides, ends and top and bottom walls, said sides of said chambers being the greater dimension of the rectangular shape of said chambers, an opening formed at one of said ends of each of said chambers in the areas of one of said top and bottom walls and in an adjacent end, a stack of samplers positioned in each of said chambers and resilient means in each of said chambers between the other of said top and bottom walls and said stack of samplers for urging said samplers transversely and toward said opening formed at said one of said ends for longitudinal withdrawal from said chambers, said samplers each consisting of a flat rectangular base with forward and rearward ends, a top and bottom surface, a depression in one of said surfaces of said base, a sample moiety in said depression in said base and a cover slip over said moiety, said cover slip extending beyond said moiety, means securing a portion of said cover slip to said base to retain said moiety in said base, said forward ends of said samplers being aligned with said openings for slidable removal endwise through said openings in said ends adjacent to said openings in said one of said top and bottom walls by drawing said samplers by frictional contact therewith through said openings in said one of said top and bottom walls.

6. A display case in accordance with claim 5 and further characterized by a plurality of bins located adjacent said chambers, each said bin comprising means for containing product corresponding to said moiety in said depressions of said samplers positioned in each of said chambers.

* * * * *